US011585344B2

(12) United States Patent
Lee et al.

(10) Patent No.: US 11,585,344 B2
(45) Date of Patent: Feb. 21, 2023

(54) COMPRESSOR PROVIDED WITH A MUFFLER

(71) Applicant: LG Electronics Inc., Seoul (KR)

(72) Inventors: Seungmock Lee, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/125,181

(22) Filed: Dec. 17, 2020

(65) Prior Publication Data

US 2021/0215155 A1 Jul. 15, 2021

(30) Foreign Application Priority Data

Jan. 10, 2020 (KR) ..... 10-2020-0003750

(51) Int. Cl.

| | |
|---|---|
| ***F04C 29/06*** | (2006.01) |
| ***F04C 2/02*** | (2006.01) |
| ***F04C 15/06*** | (2006.01) |
| ***F04C 18/02*** | (2006.01) |
| ***F04C 23/00*** | (2006.01) |

(52) U.S. Cl.

CPC ..... *F04C 29/068* (2013.01); *F04C 2/025* (2013.01); *F04C 15/06* (2013.01); *F04C 18/0215* (2013.01); *F04C 23/008* (2013.01); *F04C 29/065* (2013.01); *F04C 2240/20* (2013.01); *F04C 2240/30* (2013.01); *F04C 2270/125* (2013.01); *F04C 2270/135* (2013.01); *F05B 2260/96* (2013.01)

(58) Field of Classification Search

CPC ..... F04C 29/065–068; F04C 2270/12–135; F04C 2/025; F04C 18/0207–0292; F01C 1/0207–0292

See application file for complete search history.

(56) References Cited

U.S. PATENT DOCUMENTS

| | | | | | |
|---|---|---|---|---|---|
| 4,781,545 | A * | 11/1988 | Yokomizo | ..... | F04C 29/068 418/181 |
| 2015/0345498 | A1* | 12/2015 | Ziehr | ..... | F04C 27/008 418/228 |
| 2017/0306953 | A1* | 10/2017 | Choi | ..... | F04C 18/0269 |

FOREIGN PATENT DOCUMENTS

| | | | | | |
|---|---|---|---|---|---|
| CN | 104612970 | A | * | 5/2015 | |
| CN | 106194755 | A | * | 12/2016 | ..... F04C 18/0223 |
| JP | S59105980 | A | * | 6/1984 | |
| JP | S62088897 | U | * | 6/1987 | |
| JP | H02169891 | A | * | 6/1990 | |
| JP | H04159490 | | | 6/1992 | |
| JP | 2010116786 | | | 5/2010 | |
| KR | 970005933 | Y1 | * | 6/1997 | |
| KR | 100311375 | B1 | * | 12/2001 | |
| KR | 1020040097810 | | | 11/2004 | |

OTHER PUBLICATIONS

EP Extended European Search Report in European Appln. No. 20212669.4, dated Apr. 9, 2021, 7 pages.

* cited by examiner

*Primary Examiner* — Laert Dounis
(74) *Attorney, Agent, or Firm* — Fish & Richardson P.C.

(57) ABSTRACT

The present disclosure relates to a compressor including a branch part for reducing vibration and noise caused by a refrigerant flowing inside a muffler by expanding an enclosed space formed by a compression part and the muffler in the direction of a rotation axis.

16 Claims, 6 Drawing Sheets

Prior Art

FIG. 4
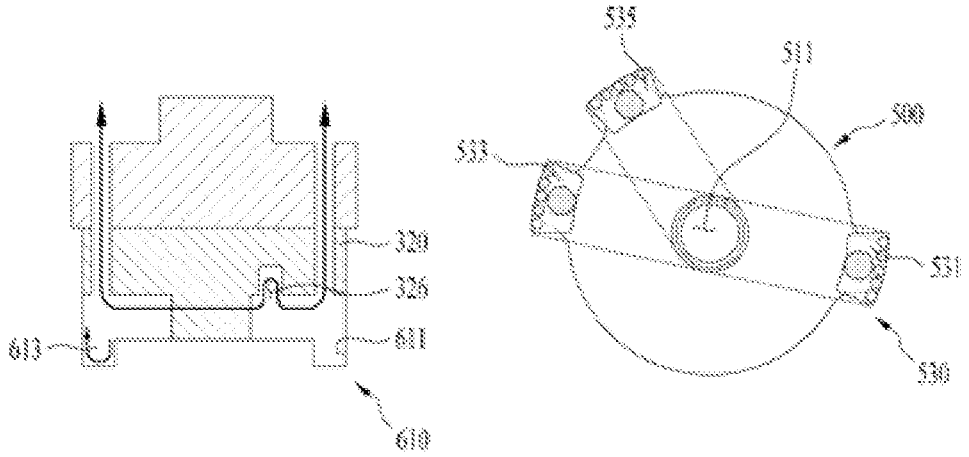
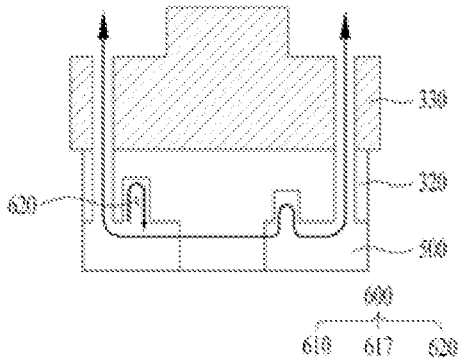
FIG. 5A
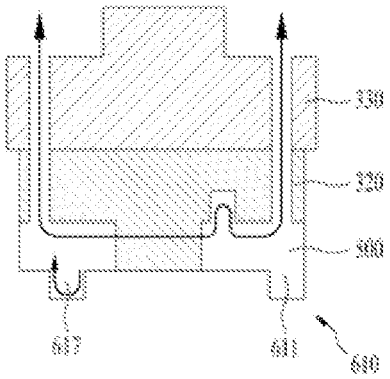
FIG. 5B

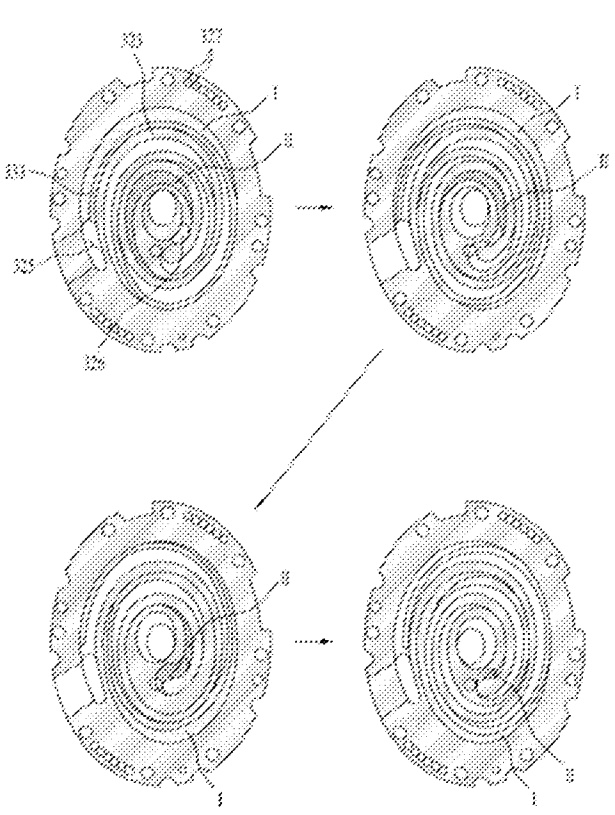
FIG. 8C
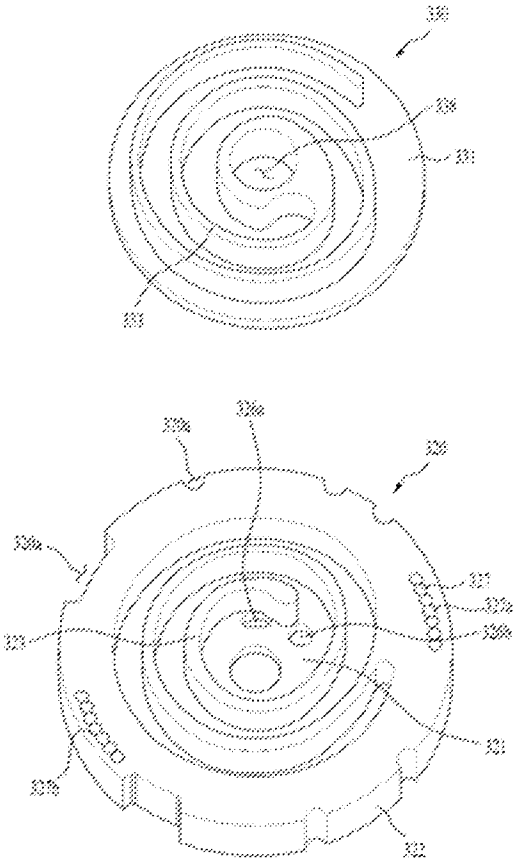
FIG. 8B
FIG. 8A

COMPRESSOR PROVIDED WITH A MUFFLER

CROSS-REFERENCE TO RELATED APPLICATION

This application claims the benefit of Korean Patent Application No. 10-2020-0003750, filed on Jan. 10, 2020, which is hereby incorporated by reference as if fully set forth herein.

TECHNICAL FIELD

The present disclosure relates to a compressor and, more particularly, to a compressor including a branch part for cancelling or mitigating vibration and noise generated in the compressor

BACKGROUND

Generally, a compressor is an apparatus applied to a refrigeration cycle such as a refrigerator or an air conditioner, which compresses a refrigerant to provide work necessary to generate heat exchange in the refrigeration cycle.

Compressors may be classified into a reciprocating compressor, a rotary compressor, and a scroll compressor depending on refrigerant compression. Among these, the scroll compressor performs an orbiting motion by engaging an orbiting scroll with a fixed scroll fixed in the internal space of a case to define a compression chamber between a fixed wrap of the fixed scroll and an orbiting wrap of the orbiting scroll.

Compared to other compressors, the scroll compressor may obtain a relatively high compression ratio since the refrigerant is continuously compressed through the scrolls engaged with each other. In addition, the scroll compressor may obtain a stable torque since the suction, compression, and discharge of the refrigerant proceed smoothly. For this reason, the scroll compressor is widely used for compressing the refrigerant in the air conditioner and the like.

A conventional scroll compressor includes a case forming the outer shape of the compressor and having an outlet for discharging a refrigerant, a compression part fixed to the case and configured to compress the refrigerant, and a driver fixed to the case and configured to drive the compression part, wherein the compression part and the driver are coupled to a rotation shaft that is coupled to the driver and configured to rotate. In the conventional scroll compressor, the rotation shaft is eccentric in the radius direction, and the orbiting scroll is fixed to the eccentric rotation shaft and rotates around the fixed scroll. Thus, the orbiting scroll compresses the refrigerant while rotating (orbiting) along the fixed wrap of the fixed scroll.

In the conventional scroll compressor, the compression part is generally disposed below the outlet, and the driver is generally disposed below the compression part. One end of the rotation shaft is coupled to the compression part, and the other end thereof extends in a direction away from the outlet and is coupled to the driver. As a result, the conventional scroll compressor has difficulty in supplying oil into the compression part since the compression part is disposed closer to the outlet than the driver (or the compression part is disposed above the driver). In addition, the conventional scroll compressor has a disadvantage of additionally requiring a lower frame to separately support the rotation shaft coupled to the compression part below the driver. Further, the conventional scroll compressor has a problem in that since the point of application of a gas force generated by the refrigerant compression does not match with that of a reaction force supporting the gas force inside the compression part, the orbiting scroll tilts and reduces the reliability thereof.

To solve such problems, a scroll compressor in which the driver is disposed close to the outlet and the compression part is disposed in a direction away from the outlet with respect to the driver has appeared (such a scroll compressor is called a lower scroll compressor).

In the lower scroll compressor, since one end of the rotation shaft farthest away from the outlet is supported to be rotatable at the compressor assembly, no lower frame is required. In addition, since oil stored in a lower portion of the case is directly supported to the compressing assembly without passing through the driver, the fixed scroll and the orbiting scroll may be rapidly lubricated. Further, when the rotation shaft penetrates the fixed scroll for coupling, the point of application of the gas force may match with that of the reaction force on the rotation shaft so that the orbiting scroll has no upsetting moments.

In the lower scroll compressor, since the compression part is disposed in the direction away from the outlet with respect to the driver, the orbiting scroll is disposed close to the outlet, and the fixed scroll is disposed farther away from the outlet than the orbiting scroll. Since the refrigerant compressed by the compression part is discharged through the fixed scroll, the refrigerant may be discharged from the compression part in the direction away from the outlet.

Accordingly, the lower scroll compressor further includes a muffler coupled to the fixed scroll in the direction away from the outlet (e.g., toward the bottom) and configured to guide the refrigerant discharged from the fixed scroll to the driver and the outlet. The muffler forms a space in which the refrigerant discharged from the compression part flows and changes its direction.

The muffler may prevent the refrigerant discharged from the compression part from colliding with the oil stored in the case and smoothly guide the high-pressure refrigerant to the outlet.

However, the refrigerant discharged from the muffler may cause a large amount of vibration and noise while the refrigerant flows inside the muffler or collides with the muffler.

To overcome such a problem, a compressor for reducing the noise caused by the refrigerant by modifying the shape and position of a discharge valve that guides the refrigerant compressed by the compression part to the muffler has been disclosed in Korean Patent Application Publication No. 10-2018-0124636.

However, considering that the vibration and noise generated in the muffler is an important issue in the lower scroll compressor, a component capable of being installed in a space formed by the muffler and the compression part and reducing the vibration and noise caused by the refrigerant is required.

SUMMARY

Accordingly, the present disclosure is directed to a compressor that substantially obviates one or more problems due to limitations and disadvantages of the related art.

An object of the present disclosure is to mitigate vibration and noise caused by a refrigerant flowing inside a muffler.

Another object of the present disclosure is to mitigate the vibration and noise generated in the muffler without additional components.

Another object of the present disclosure is to mitigate the vibration and noise caused by the refrigerant while reducing the flow loss of the refrigerant Another object of the present disclosure is to offset vibration with a specific frequency caused by the refrigerant.

A further object of the present disclosure is to offset vibration with various frequencies caused by the refrigerant.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, particular implementations of the present disclosure provide a compressor that includes a case, a rotation shaft, a driver, a compression part, a muffler, and a branch part. The case may include an outlet configured to discharge refrigerant. The driver may be coupled to the case and configured to rotate the rotation shaft. The compression part may be coupled to the rotation shaft and configured to compress the refrigerant. The muffler may be coupled to the compression part. The muffler and the compression part may define an enclosed space configured to guide the refrigerant to the outlet of the case. The branch part may extend from at least one of the compression part or the muffler in a longitudinal direction of the rotation shaft and may define an additional space to the enclosed space. The additional space may be configured to reduce vibration or noise caused by movement of the refrigerant.

In some implementations, the compressor can optionally include one or more of the following features. The branch part may extend from the muffler in a first direction away from the compression part. The muffler may include a muffler shaft support portion that is coupled to the rotation shaft, and collector part that extends from the muffler in a radial direction of the rotation shaft away from the rotation shaft and that is configured to guide the refrigerant to the outlet of the case. The branch part may extend from the collector part in the first direction away from the compression part. The collector part may include a first collector that extends from a first side of the muffler in the radial direction of the rotation shaft away from the enclosed space, and a second collector that extends from a second side of the muffler in the radial direction of the rotation shaft away from the enclosed space. The branch part may include a first branch that extends from the first collector in the first direction away from the compression part, and a second branch that extends from the second collector in the first direction away from the compression part. A length of extension of the first branch from the first collector in the first direction away from the compression part may be different from a length of extension of the second branch from the second collector in the first direction away from the compression part. The first and second branches may extend from opposite positions with respect to the first direction away from the compression part. The branch part may be tapered in the first direction away from the compression part. The branch part may include a shaft support portion branch that extends between the collector part and the muffler shaft support portion in the first direction away from the compression part. A length of extension of the shaft support portion branch from the muffler in the first direction away from the compression part may be different from a length of extension of the first branch from the first collector in the first direction away from the compression part. The compressor may include a resonator that is disposed at the muffler and that defines a cavity by dividing the enclosed space such that the vibration or noise caused by movement of the refrigerant is reduced. The compressor may include a fixed scroll that is coupled to the muffler, and an orbiting scroll that is coupled to the rotation shaft and that is disposed relative to the fixed scroll in a second direction away from the muffler. The fixed scroll and the orbiting scroll define a compression chamber in which the refrigerant is compressed. The branch part may be recessed from the fixed scroll in the second direction away from the muffler. The fixed scroll may include a fixed penetration hole that receives the rotation shaft, and a discharge hole that is defined at a location away from the fixed penetration hole and that is configured to discharge, to the muffler, the refrigerant compressed in the compression chamber. A distance between the branch part and the fixed penetration hole may be greater than a distance between the discharge hole and the fixed penetration hole. The fixed scroll may include a bypass hole that is configured to guide the refrigerant discharged from the discharge hole to the outlet of the case. A distance between the bypass hole and the fixed penetration hole may be greater than a distance between the branch part and the fixed penetration hole. The bypass hole may include a first by pass hole and a second bypass hole. The first bypass hole may be configured to guide, to the outlet of the case, the refrigerant discharged from the discharge hole based on the first bypass hole being located opposite to the fixed penetration hole with respect to the discharge hole. The second bypass hole may be configured to guide, to the outlet of the case, the refrigerant discharged from the discharge hole based on the second bypass hole being located opposite to the discharge hole with respect to the fixed penetration hole. The branch part may be located between the second bypass hole and the fixed penetration hole. A distance between the branch part and the second bypass hole may be smaller than a distance between the discharge hole and the first bypass hole. The driver may include a stator that is configured to generate a magnetic field, and a rotor that is coupled to the rotation shaft and configured to rotate based on the magnetic field. The muffler may include a coupling body that is coupled to the fixed scroll, and a receiving body that extends from the coupling body and defines a sealed space. The muffler may include a first collector that extends in the radial direction of the rotation shaft away from the enclosed space, a second collector that extends in the radial direction of the rotation shaft away from the enclosed space, and a third collector that is disposed between the first and second collector. The third collector may be disposed closer to the second collector than the first collector. The first collector may extend in an opposite direction to the second collector.

To achieve these objects and other advantages and in accordance with the purpose of the disclosure, as embodied and broadly described herein, a compressor for reducing vibration and noise caused by a refrigerant by creating a space in an opposite direction to a flow path of the refrigerant is provided.

In another aspect of the present disclosure, a compressor for cancelling vibration and noise caused by a refrigerant based on a phase difference is provided.

In a further aspect of the present disclosure, a compressor is provided. The compressor may include: a case having an outlet configured to discharge a refrigerant at one side thereof; a driver coupled to the case and configured to rotate a rotation shaft; a compression part coupled to the rotation shaft and configured to compress the refrigerant; a muffler coupled to the compression part and configured to provide an enclosed space for guiding the refrigerant to the outlet; and a branch part protruding and extending from at least one of the compression part or the muffler in a direction of the rotation shaft and configured to expand the enclosed space and reduce vibration or noise caused by the refrigerant.

The branch part may protrude and extend from the muffler in a direction away from the compression part.

The muffler may include: a muffler shaft support portion formed by penetration and coupled to the rotation shaft; and a collector part protruding and extending from the muffler in a direction away from the rotation shaft and configured to guide the refrigerant to the outlet. In this case, the branch part may protrude and extend from the collector part in the direction away from the compression part.

The collector part may include: a first collector protruding and extending from a first side of the muffler in a direction away from the enclosed space; and a second collector protruding and extending from a second side of the muffler in the direction away from the enclosed space. The branch part may include: a first branch protruding and extending from the first collector in the direction away from the compression part; and a second branch protruding and extending from the second collector in the direction away from the compression part.

The degree of protrusion and extension of the first branch from the first collector in the direction away from the compression part may be different from the degree of protrusion and extension of the second branch from the second collector in the direction away from the compression part.

The first and second branches may protrude and extend from opposite positions in the direction away from the compression part.

The branch part may be tapered as the branch part is farther away from the compression part.

The branch part may further include a shaft support portion branch protruding and extending between the collector part and the muffler shaft support portion in the direction away from the compression part.

The degree of protrusion and extension of the shaft support portion branch from the muffler in the direction away from the compression part may be different from the degree of protrusion and extension of the first branch from the first collector in the direction away from the compression part.

The compressor may further include a resonator disposed on the muffler and configured to form a cavity by dividing the enclosed space such that the vibration or noise caused by the refrigerant is reduced.

The compression part may include: a fixed scroll coupled to the muffler; and an orbiting scroll disposed in a direction away from the muffler with respect to the fixed scroll and coupled to the rotation shaft, wherein the orbiting scroll may be configured to form a compression chamber in which the refrigerant is compressed through engagement with the fixed scroll. In this case, the branch part may be recessed from the fixed scroll in the direction away from the muffler.

The fixed scroll may include: a fixed penetration hole penetrated by the rotation shaft; and a discharge hole formed by penetrating the fixed scroll at a location away from the fixed penetration hole and configured to discharge the refrigerant compressed in the compression chamber to the muffler. In this case, the branch part may be recessed at the location away from the fixed penetration hole in the direction away from the muffler such that a distance between the branch part and the fixed penetration hole is greater than a distance between the discharge hole and the fixed penetration hole.

The fixed scroll may include a bypass hole formed by penetrating the fixed scroll and configured to guide the refrigerant discharged from the discharge hole to the outlet. The bypass hole may be formed at a location at which a distance between the bypass hole and the fixed penetration hole is greater than a distance between the branch part and the fixed penetration hole.

The bypass hole may include: a first bypass hole configured to guide the refrigerant to the outlet when the first bypass hole is located in a direction away from the fixed penetration hole with respect to the discharge hole; and a second bypass hole configured to guide the refrigerant discharged from the discharge hole to the outlet when the second bypass hole is located in a direction away from the discharge hole with respect to the fixed penetration hole. In this case, the branch part may be located between the second bypass hole and the fixed penetration hole.

The branch part may be formed at a location at which a distance between the branch part and the second bypass hole is smaller than a distance between the discharge hole and the first bypass hole.

It is to be understood that both the foregoing general description and the following detailed description of the present disclosure are exemplary and explanatory and are intended to provide further explanation of the disclosure as claimed.

As is apparent from the above description, the present disclosure has effects as follows.

According to the present disclosure, the compressor may mitigate the vibration and noise caused by the refrigerant flowing inside the muffler without additional components.

The compressor may offset vibration with various frequencies generated in the muffler.

The compressor may offset vibration with a specific frequency generated in the muffler.

The compressor may effectively mitigate the vibration and noise that depend on the flow path of the refrigerant flowing inside the muffler.

The compressor may reduce the flow loss of the refrigerant flowing inside the muffler.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIG. 4 is a view showing an example in which the branch part is formed in the muffler according to one implementation of the present disclosure;

FIGS. 5A and 5B are views showing an example in which the branch part is formed in the muffler and a fixed scroll according to one implementation of the present disclosure;

FIGS. 8A to 8C are views showing the operating principle of the compressor according to one implementation of the present disclosure.

DETAILED DESCRIPTION

Figure 1A:
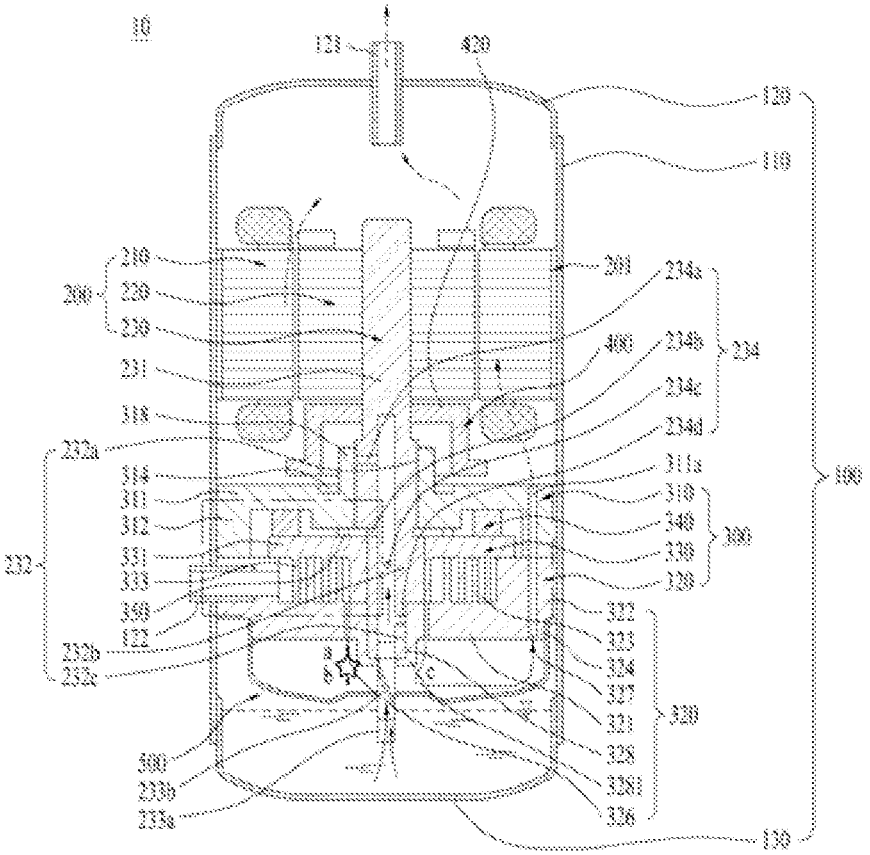
FIGS. 1A and 1B are views showing a lower scroll compressor according to one implementation of the present disclosure.

Reference will now be made in detail to one or more implementations of the present disclosure, examples of which are illustrated in the accompanying drawings.

For clarification and convenience of description, the size and shape of each element shown in the drawings may be enlarged, or downsized. The terms defined in consideration of the configurations and operations of the present disclosure may be modified depending on the intention of a user or person skilled in the art or practices.

Although the terms such as "first" and/or "second" in this specification may be used to describe various elements, it is to be understood that the elements are not limited by such terms. The terms may be used to identify one element from another element. For example, the first element may be referred to as the second element and vice versa within the range that does not depart from the scope of the present disclosure.

The terms used herein should be understood not simply by the actual terms used but by the meaning lying within and the description disclosed herein.

Figure 1B:
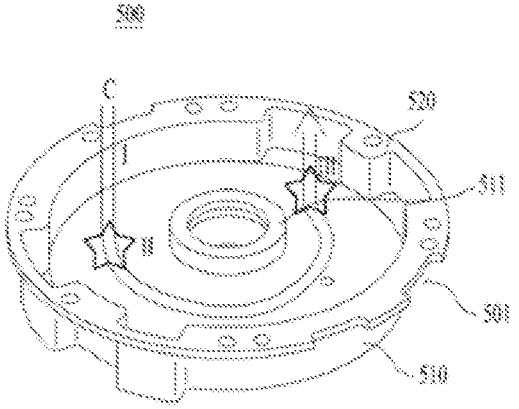

FIGS. 1A and 1B are views showing a basic structure of a lower scroll compressor 10 according to one implementation of the present disclosure.

The lower scroll compressor 10 according to one implementation of the present disclosure may include a case 100 providing a space in which fluid is stored or flows, a driver 200 coupled to the inner circumferential surface of the case 100 and configured to rotate a rotation shaft 230, and a compression part 300 coupled to the rotation shaft 230 inside the case 100 and configured to compress the fluid.

Specifically, the case 100 may include an inlet 122 into which a refrigerant flows and an outlet 121 through which the refrigerant is discharged. The case 100 may include a receiving shell 110 provided in a cylindrical shape, a discharge shell 120 coupled to a first end of the receiving shell 110, and a sealing shell 130 coupled to a second end of the receiving shell 110. More specifically, the driver 200 and the compression part 300 are installed in the receiving shell 110, and the inlet 122 is disposed on the receiving shell 110. The outlet 121 is disposed on the discharge shell 120. The sealing shell 130 is configured to seal the receiving shell 110.

The driver 200 may include a stator 210 configured to generate a rotating magnetic field and a rotor 220 configured to rotate by the rotating magnetic field. The rotation shaft 230 may be coupled to the rotor 220 so that the rotation shaft 230 may rotate together with the rotor 220.

The stator 210 may have a plurality of slots on the inner circumferential surface thereof along a circumferential direction, and a coil may be wound around the plurality of slots such that the rotating magnetic field (or rotating field) is generated. The stator 210 may be fixed to the inner circumferential surface of the receiving shell 110. The rotor 220 may include a plurality of magnetic substances (e.g., permanent magnet) configured to react with the rotating magnetic field. The rotor 220 may be disposed inside the stator 210 and rotate thereinside. The rotation shaft 230 may be pressed into and coupled to the center of the rotor 220 so that the rotation shaft 230 may rotate together with the rotor 220 when the rotor 220 rotates due to the rotating magnetic field.

The compression part 300 may include a fixed scroll 320 coupled to the inner circumferential surface of the receiving shell 110 and disposed in a direction away from the outlet 121 with respect to the driver 200, an orbiting scroll 330 coupled to the rotation shaft 230 and engaged with the fixed scroll 320 to form a compression chamber, and a main frame 310 seated on the fixed scroll 320, wherein the orbiting scroll 330 is installed in the main frame 310.

The lower scroll compressor 10 may include the driver 200 disposed between the outlet 121 and the compression part 300. When the outlet 121 is disposed on the top of the case 100, the compression part 300 may be disposed below the driver 200, and the driver 200 may be disposed between the outlet 121 and the compression part 300.

Thus, when oil is stored on the bottom surface of the case 100, the oil may be supplied directly to the compression part 300 without passing through the driver 200. In addition, since the rotation shaft 230 is coupled to and supported by the compression part 300, an extra lower frame for supporting the rotation shaft 230 may be omitted.

The lower scroll compressor 10 may be provided such that the rotation shaft 230 penetrates not only the orbiting scroll 330 but also the fixed scroll 320 to be in face contact with both the orbiting scroll 330 and the fixed scroll 320. Thus, an inflow force generated when the fluid such as the refrigerant flows into the compression part 300, a gas force generated when the refrigerant is compressed in the compression part 300, and a reaction force therefor may be directly applied to the rotation shaft 230. That is, the inflow force, the gas force, and the reaction force may be concentrated on the rotation shaft 230. As a result, since an upsetting moment does not act on the orbiting scroll 330 coupled to the rotation shaft 230, tilting or upsetting of the orbiting scroll 330 may be blocked. In other words, tilting of the orbiting scroll 330 in an axial direction may be attenuated or prevented, and thus noise and vibration generated by the orbiting scroll 330 may be improved.

In the lower scroll compressor 10, the rotation shaft 230 may absorb or support a back pressure generated while the refrigerant is discharged to outside so that a force (normal force) by which the orbiting scroll 330 and the fixed scroll 320 become excessively close to each other in the axial direction may also be reduced. Therefore, a friction force between the orbiting scroll 330 and the fixed scroll 320 may be significantly reduced, thereby improving the durability of the compression part 300.

The main frame 310 may include a main end plate 311 provided at one side of the driver 200 or at the bottom of the driver 200, a main side plate 312 extending in a direction away from the driver 200 with respect to the inner circumferential surface of the main end plate 311 and seated on the fixed scroll 320, and a main shaft support portion 318 extending from the main end plate 311 to rotatably support the rotation shaft 230.

A main hole 311*a* for guiding the refrigerant discharged from the fixed scroll 320 to the outlet 121 may be further formed in the main end plate 311 or the main side plate 312. The main end plate 311 may further include an oil pocket 314 engraved on the outer surface of the main shaft support portion 318. The oil pocket 314 may have an annular shape and be provided such that the oil pocket 314 tilts toward the main shaft support portion 318. The oil pocket 314 may be provided such that when the oil stored in the sealing shell 130 is transferred thereto through the rotation shaft 230, the oil is supplied to a portion where the fixed scroll 320 and the orbiting scroll 330 are engaged with each other.

The fixed scroll 320 may include a fixed end plate 321 coupled to the receiving shell 110 in a direction away from the driver 200 with respect to the main end plate 311 and forming one surface of the compression part 300, a fixed side plate 322 extending from the fixed end plate 321 to the outlet 121 to be in contact with the main side plate 312, and a fixed wrap 323 disposed on the inner circumferential surface of the fixed side plate 322 to form the compression chamber in which the refrigerant is compressed.

The fixed scroll 320 may include a fixed penetration hole 328 penetrated by the rotation shaft 230 and a fixed shaft support portion 3281 extending from the fixed penetration hole 328 and supporting that the rotation shaft 230 such that the rotation shaft 230 rotates. The fixed shaft support portion 3281 may be disposed at the center of the fixed end plate 321.

The thickness of the fixed end plate 321 may be equal to the thickness of the fixed shaft support portion 3281. In this case, the fixed shaft support portion 3281 may be inserted into the fixed penetration hole 328, instead of protruding from the fixed end plate 321.

The fixed side plate 322 may include an inflow hole 325 configured to allow the refrigerant to flow into the fixed wrap 323, and the fixed end plate 321 may include a discharge hole 326 through which the refrigerant is discharged. Although the discharge hole 326 may be formed at the center of the fixed wrap 323, it may be spaced apart from the fixed shaft support portion 3281 to avoid interference with the fixed shaft support portion 3281. Alternatively, a plurality of discharge holes 326 may be provided.

The orbiting scroll 330 may include an orbiting end plate 331 disposed between the main frame 310 and the fixed scroll 320 and an orbiting wrap 333 forming the compression chamber together with the fixed wrap 323 on the orbiting end plate 331. The orbiting scroll 330 may further include an orbiting through hole 338 formed by penetrating the orbiting end plate 331 such that the rotation shaft 230 is rotatably coupled.

The rotation shaft 230 may be disposed such that a portion thereof coupled to the orbiting through hole 338 tilts. Thus, when the rotation shaft 230 rotates, the orbiting scroll 330 moves while being engaged with the fixed wrap 323 of the fixed scroll 320 to compress the refrigerant.

Specifically, the rotation shaft 230 may include a main shaft 231 coupled to the driver 200 and configured to rotate and a bearing portion 232 connected to the main shaft 231 and rotatably coupled to the compression part 300. The bearing portion 232 may be included as a member separate from the main shaft 231. In particular, the bearing portion 232 may accommodate the main shaft 231 or be integrated with the main shaft 231.

The bearing portion 232 may include a main bearing portion 232*a* inserted into the main shaft support portion 318 of the main frame 310 and supported in the radius direction, a fixed bearing portion 232*c* inserted into the fixed shaft support portion 3281 of the fixed scroll 320 and supported in the radius direction, and an eccentric shaft 232*b* disposed between the main bearing portion 232*a* and the fixed bearing portion 232*c* and inserted into the orbiting through hole 338 of the orbiting scroll 330.

In this case, the main bearing portion 232*a* and the fixed bearing portion 232*c* may be coaxial to have the same axis center, and the eccentric shaft 232*b* may be formed such that the center of gravity thereof is radially eccentric with respect to the main bearing portion 232*a* or the fixed bearing portion 232*c*. In addition, the outer diameter of the eccentric shaft 232*b* may be greater than the outer diameter of the main bearing portion 232*a* or the outer diameter of the fixed bearing portion 232*c*. Thus, when the bearing portion 232 rotates, the eccentric shaft 232*b* may provide a force for compressing the refrigerant while rotating the orbiting scroll 330 therearound. The orbiting scroll 330 may be provided such that the orbiting scroll 330 regularly orbits around the fixed scroll 320 by the eccentric shaft 232*b*.

To prevent the orbiting scroll 330 from rotating, the lower scroll compressor 10 may further include an Oldham ring 340 coupled to an upper portion of the orbiting scroll 330. The Oldham ring 340 may be disposed between the orbiting scroll 330 and the main frame 310 to be in contact with both the orbiting scroll 330 and the main frame 310. The Oldham ring 340 may be disposed to move straight in the four directions: front, rear, left, and right in order to prevent the rotation of the orbiting scroll 330.

The rotation shaft 230 may be disposed to completely penetrate the fixed scroll 320 so that the rotation shaft 230 may protrude out of the compression part 300. That is, the rotation shaft 230 may be in direct contact with the outside of the compression part 300 and the oil stored in the sealing shell 130. The rotation shaft 230 may rotate to draw and supply the oil into the compression part 300.

In particular, an oil supply path 234 for supplying the oil to the outer circumferential surface of the main bearing portion 232*a*, the outer circumferential surface of the fixed bearing portion 232*c*, and the outer circumferential surface of the eccentric shaft 232*b* may be formed on the outer circumferential surface of the rotation shaft 230 or inside the rotation shaft 230.

A plurality of oil supply holes 234*a*, 234*b*, 234*c*, and 234*d* may be formed on the oil supply path 234. Specifically, the oil supply holes may include a first oil supply hole 234*a*, a second oil supply hole 234*b*, a third oil supply hole 234*c*, and a fourth oil supply hole 234*d*. The first oil supply hole 234*a* may be formed such that it penetrates the outer circumferential surface of the main bearing portion 232*a*.

For example, the first oil supply hole 234*a* may be formed to penetrate an upper portion of the outer circumferential surface of the main bearing portion 232*a*. However, the present disclosure is not limited thereto. That is, the first oil supply hole 234*a* may be formed to penetrate a lower portion of the outer circumferential surface of the main bearing portion 232*a*. A plurality of first oil supply holes 234*a* may be provided in contrast to the drawing. When the plurality of first oil supply holes 234*a* are provided, the plurality of first oil supply holes 234*a* may be formed only in the either upper or lower portion of the outer circumferential surface of the main bearing portion 232*a*. Alternatively, the plurality of first oil supply holes 234*a* may be formed in both the upper and lower portions of the outer circumferential surface of the main bearing portion 232*a*.

The rotation shaft 230 may include an oil feeder 233 that penetrates a muffler 500, which will be described later, and is in contact with the oil stored in the case 100. The oil feeder 233 may include an extension shaft 233*a* penetrating the muffler 500 and in contact with the oil and a spiral groove 233*b* formed on the outer circumferential surface of the extension shaft 233*a* and connected to the oil supply path 234.

Thus, when the rotation shaft 230 rotates, the oil is lifted by the oil feeder 233 along the oil supply path 234 due to the spiral groove 233*b*, the viscosity of the oil, and a pressure difference between a high-pressure region and an intermediate-pressure region inside the compression part 300. Then, the lifted oil is discharged into the plurality of oil supply holes. The oil discharged through the plurality of oil supply holes 234*a*, 234*b*, 234*c*, and 234*d* not only maintains airtight condition by forming an oil film between the fixed scroll 320 and the orbiting scroll 330 but also absorbs and dissipates frictional heat generated between the components in the compression part 300.

The oil supplied through the first oil supply hole 234*a* may lubricate the main frame 310 and the rotation shaft 230. The oil may be discharged through the second oil supply hole 234*b* and supplied to the top surface of the orbiting scroll 330. The oil supplied to the top surface of the orbiting scroll 330 may be guided to the intermediate-pressure region through a pocket groove 314. The oil discharged through the first or third oil supply hole 234*a* or 234*c* as well as the oil discharged through the second oil supply hole 234*b* may be provided to the pocket groove 314.

The oil guided by the rotation shaft 230 may be supplied to the Oldham ring 340, which is installed between the orbiting scroll 330 and the main frame 310, and the fixed side plate 322 of the fixed scroll 320. Thus, the abrasion between the Oldham ring 340 and the fixed side plate 322 of the fixed scroll 320 may be reduced. In addition, since the oil supplied through the third oil supply hole 234*c* is provided to the compression chamber, it may not only reduce the abrasion and friction between the orbiting scroll 330 and the fixed scroll 320 but also form the oil film and dissipate the heat, thereby improving compression efficiency.

Although a centrifugal oil supply structure in which the lower scroll compressor 10 supplies the oil to the bearing based on the rotation shaft 230 has been described, it is merely an example. That is, a differential pressure supply structure in which oil is supplied based on the pressure difference inside the compression part 300 and a forced oil supply structure in which oil is supplied by on a trochoid pump, etc. may also be applied.

The compressed refrigerant flows into the discharge hole 326 through a space defined by the fixed wrap 323 and the orbiting wrap 333. It may be desired that the discharge hole 326 is disposed toward the outlet 121. The reason for this is that the refrigerant discharged from the discharge hole 326 needs to be delivered to the outlet 121 without a large change in the flow direction.

However, due to the structural characteristics of the compressor, that is, since the compression part 300 needs to be provided in a direction away from the outlet 121 with respect to the driver 200 and the fixed scroll 320 needs to be disposed at the outermost portion of the compression part 300, the discharge hole 326 is disposed to spray the refrigerant in a direction opposite to the outlet 121.

In other words, the discharge hole 326 is disposed to spray the refrigerant in a direction away from the outlet 121 with respect to the fixed end plate 321. Therefore, when the refrigerant is sprayed through the discharge hole 326, the refrigerant may not be smoothly discharged to the outlet 121. When the oil is stored in the sealing shell 130, the refrigerant may collide with the oil so that the refrigerant may be cooled or mixed with the oil.

To overcome such a problem, the compressor 10 may further include the muffler 500 coupled to the outermost portion of the fixed scroll 320 and configured to provide a space for guiding the refrigerant to the outlet 121.

The muffler 500 may be configured to seal one surface of the fixed scroll 320 facing in a direction away from the outlet 121 to guide the refrigerant discharged from the fixed scroll 320 to the outlet 121.

The muffler 500 may include a coupling body 520 coupled to the fixed scroll 320 and a receiving body 510 extending from the coupling body 520 and forming a sealed space. Thus, the refrigerant sprayed from the discharge hole 326 may be discharged to the outlet 121 by switching the flow direction thereof along the sealed space formed by the muffler 500.

Since the fixed scroll 320 is coupled to the receiving shell 110, the refrigerant may be restricted from flowing into the outlet 121 due to interruption by the fixed scroll 320. Thus, the fixed scroll 320 may further include a bypass hole 327 penetrating the fixed end plate 321 and configured to allow the refrigerant to pass through the fixed scroll 320. The bypass hole 327 may be connected to the main hole 317. Thus, the refrigerant may pass through the compression part 300, go by the driver 200, and then be discharged to the outlet 121.

As the refrigerant flows inward from the outer circumferential surface of the fixed wrap 323, the pressure of the refrigerant increases. Thus, the interiors of the fixed wrap 323 and orbiting wrap 333 may be maintained at a high pressure. Accordingly, the discharge pressure is applied to the rear face of the orbiting scroll 330, and the back pressure is applied in a direction from the orbiting scroll 330 toward the fixed scroll 320 in reaction thereto. The compressor 10 may further include a back pressure seal 350 configured to concentrate the back pressure on a portion in which the orbiting scroll 330 and the rotation shaft 230 are coupled to each other and prevent leakage between the orbiting wrap 333 and the fixed wrap 323.

The back pressure seal 350 is formed in a ring shape and configured to maintain the inner circumferential surface thereof at a high pressure and isolate the outer circumferential surface thereof at an intermediate pressure lower than the high pressure. Therefore, the back pressure is concentrated on the inner circumferential surface of the back pressure seal 350 so that the orbiting scroll 330 is in close contact with the fixed scroll 320.

Considering that the discharge hole 326 is spaced apart from the rotation shaft 230, the back pressure seal 350 may be provided such that the center thereof tilts toward the discharge hole 326. When the refrigerant is discharged to the outlet 121, the oil supplied to the compression part 300 or the oil stored in the case 100 may flow into an upper portion of the case 100 together with the refrigerant. Since the density of the oil is greater than that of the refrigerant, the oil may not flow into the outlet 121 due to a centrifugal force generated by the rotor 220. Specifically, the oil may be attached to the inner walls of the discharge shell 120 and receiving shell 110. The lower scroll compressor 10 may further include a recovery passage F formed on the outer circumferential surfaces of the driver 200 and compression part 300 to recover the oil attached to the inner wall of the case 100 and store the recovered oil in an oil storage space of the case 100 or the sealing shell 130.

The recovery passage F may include a driver recovery passage 201 formed on the outer circumferential surface of the driver 200, a compression recovery passage 301 formed on the outer circumferential surface of the compression part 300, and a muffler recovery passage 501 formed on the outer circumferential surface of the muffler 500.

The driver recovery passage 201 may be formed by recessing a portion of the outer circumferential surface of the stator 210. The compression recovery passage 301 may be formed by recessing a portion of the outer circumferential surface of the fixed scroll 320. The muffler recovery passage 501 may be formed by recessing a portion of the outer circumferential surface of the muffler 500. The driver recovery passage 201, the compression recovery passage 301, and the muffler recovery passage 501 may be connected with each other so that the oil is allowed to pass therethrough.

Since the center of gravity of the rotation shaft 230 is biased to one side due to the eccentric shaft 232*b*, an unbalanced eccentric moment occurs during the rotation, and as a result, the overall balance may be distorted. Thus, the lower scroll compressor 10 may further include a balancer 400 configured to offset the eccentric moment caused by the eccentric shaft 232*b*.

Since the compression part 300 is fixed to the case 100, the balancer 400 may be coupled to the rotation shaft 230 or the rotor 220. Thus, the balancer 400 may include a central balancer 420 disposed on a lower portion of the rotor 220 or on a first surface facing the compression part 300 to offset or reduce the eccentric load of the eccentric shaft 232*b* and an outer balancer 410 coupled to a top portion of the rotor 220 or to a second surface facing the outlet 121 to offset the eccentric load or eccentric moment of the eccentric shaft 232*b*.

Since the central balancer 420 is relatively close to the eccentric shaft 232*b*, the central balancer 420 may directly offset the eccentric load of the eccentric shaft 232*b*. Thus, the central balancer 420 may be eccentrically disposed in a direction opposite to the direction in which the eccentric shaft 232*b* tilts. That is, even when the rotation shaft 230 rotates at a low speed or at a high speed, the central balancer 420 may effectively offset the eccentric force or eccentric load generated by the eccentric shaft 232*b* almost uniformly since the distance to the eccentric shaft 232*b* is not great.

The outer balancer 410 may be eccentrically disposed in a direction opposite to the direction in which the eccentric shaft 232*b* tilts. However, the outer balancer 410 may be eccentrically disposed in a direction corresponding to the eccentric shaft 232*b* to partially offset the eccentric load generated by the central balancer 420. Accordingly, the central balancer 420 and the outer balancer 410 may offset the eccentric moment generated by the eccentric shaft 232*b* to assist the rotation shaft 230 to rotate stably.

Referring to FIG. 1A, a plurality of discharge holes 326 may be provided.

In normal scroll compressors, the fixed wrap 323 and the orbiting wrap 333 spirally extend, for example, in an involute or logarithmic spiral shape with respect to the center of the fixed scroll 320. Thus, the discharge hole 326 is typically disposed at the center of the fixed scroll 320 since the pressure thereof is highest.

However, since the lower scroll compressor 10 includes the rotation shaft 230 that penetrates the fixed end plate 321 of the fixed scroll 320, the discharge hole 326 may not be located at the center of the wrap. In particular, the compressor 10 may respectively include discharge holes 326*a* and 326*b* on the inner and outer circumferential surfaces of the center part of the orbiting scroll 330 (see FIGS. 8A to 8C).

When the compressor 10 runs with small loads, the refrigerant may be excessively compressed in a space where the discharge hole 326 is provided, and it may cause efficiency degradation. Thus, a plurality of discharge holes may be further provided along the inner or outer circumferential surface of the orbiting wrap 333 (multi-discharging).

The compressor 10 may not include a discharge valve configured to selectively close the plurality of discharge holes 326. The reason for this is to avoid a tapping sound generated when the discharge valve collides with the fixed scroll 320.

The refrigerant discharged in direction A from one of the plurality of discharge holes 326 is sprayed into the muffler 500. However, when the fixed scroll 320 has no discharge valve for closing the discharge hole 326, the pressure of the refrigerant discharged into the muffler 500 may temporarily increase, and as a result, the refrigerant may flow backward into direction B. In particular, when the orbiting scroll 330 rotates and the pressure around discharge hole 326 temporarily decrease, the refrigerant in the compression chamber (direction A) may directly collide with the refrigerant flowing backward (direction B), and it may cause pressure pulsations.

In this case, a large amount of impact and noise may occur inside the muffler 500 and the compression part 300. In particular, when the frequency of the pressure pulsations is the same as the fixed frequency of the muffler 500 or compression part 300, a resonance phenomenon may occur. That is, a large amount of vibration and noise may occur.

Referring to FIG. 1B, it is assumed that that the refrigerant flows in direction C. When the refrigerant flows in direction I, the refrigerant may collide with the receiving body 510 of the muffler 500 first. When the refrigerant flows in direction II, the refrigerant may collide with the inner circumferential surface of the receiving body 510. When the refrigerant flows into the bypass hole 327 in direction III, it may cause a repulsive force to the receiving body 510.

While the refrigerant collides with the muffler 500 three times, it may cause the friction and repulsive force, and the friction and repulsive force may also cause vibration and noise. In particular, if the frequency of the refrigerant is equivalent to the resonance frequency of the muffler 500, the resonance phenomenon occurs so that a large amount of vibration and resonance may occur.

Hereinafter, the vibration and noise caused by the refrigerant discharged from the muffler 500 will be described with reference to FIGS. 2A and 2B.

Figure 2A:
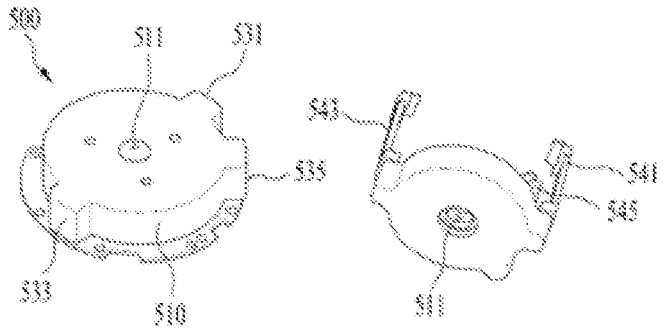
FIGS. 2A and 2B are views showing a muffler of a conventional lower scroll compressor.
Figure 2B:
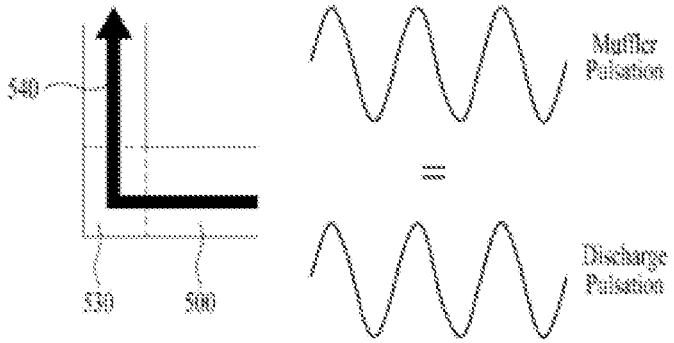
Prior Art FIG. 2B

FIGS. 2A and 2B are views illustrating the muffler 500 of the lower scroll compressor 10.

The muffler 500 may include a collector part 530 configured to collect the refrigerant discharged from the discharge hole 326 and a guider 540 configured to guide the refrigerant collected by the collector part 530 to the outlet 121.

The collector part 530 may protrude and extend in a direction away from an enclosed space formed by the compression part 300 and the muffler 500 with respect to the outer circumferential surface of the receiving body 510. Thus, the refrigerant compressed by the compression part 300 may flow into the inside of the muffler 500, collide with the receiving body 510, and then be collected at the collector part 530.

A plurality of collectors 530 may be disposed along the circumference of the receiving body 510. Both a first collector 531 and a second collector 533 may protrude and extend in the direction away from the enclosed space formed by the compression part 300 and the muffler 500. However, the first and second collectors 531 and 533 may protrude and extend in opposite directions.

In other words, the first and second collectors 531 and 533 may protrude and extend in the outer direction of the first collector 531 while facing with each other.

The collector part 530 may include a third collector 535 disposed between the first and second collectors 531 and 533. In this case, the third collector 535 may be disposed closer to the second collector 533 than the first collector 531.

To guide the refrigerant collected by the collector part 530 to the outlet 121, the guider 540 may be coupled to one side of the collector part 530, which is close to the compression part 300, and extend toward the outlet 121.

The guider 540 may extend in parallel to the rotation shaft 230, penetrate the compression part 300, and be connected to the main hole 311*a*. The compressor 10 may include a plurality of guiders 541, 543, and 545 respectively corresponding to the plurality of collectors 530.

A first guider 541 may be coupled to the first collector 531 and extend toward the outlet 121. Similarly, second and third guider 543 and 545 may be coupled to the second and third collectors 533 and 535, respectively and extend toward the outlet 121.

The refrigerant compressed by the compression part 300 may be discharged to the receiving body 510 and guided to the outlet 121. In other words, the refrigerant discharged from the discharge hole 326 may pass through the receiving body 510 and then flow into the collector part 530. The collector part 530 may collect the refrigerant, and the guider 540 may guide the collected refrigerant to the outlet 121.

Although FIGS. 2A and 2B show that the muffler 500 includes three collectors 530 and three guiders 540, the present disclosure is not limited thereto. That is, the number of collectors 530 and the number of guiders 540 may increase.

As described above, while the refrigerant is discharged through the discharge hole 326, pulsations may occur due to the pressure difference. In this case, since the vibration and noise generated in the muffler 500 are maintained, the refrigerant may be guided to the outlet 121 while maintaining the pulsations.

To reduce the vibration and noise caused by the refrigerant discharged from the muffler 500, the compressor 10 may further include a branch part 600. The branch part 600 may protrude and extend from the compression part 300 or the muffler 500 and configured to expand the enclosed space formed by the compression part 300 and the muffler 500.

Since a first end of the branch part 600 is open, and a second end thereof is closed, the branch part 600 may generate a frequency with an opposite phase to the vibration caused by the refrigerant. That is, the frequency of the vibration and noise is maximized at the first end of the branch part 600 but converges to zero at the second end of the branch part 600. In summary, the branch part 600 may generate the opposite phase to the frequency of the vibration and noise caused by the refrigerant and thus mitigate the vibration and noise.

As long as the first end of the branch part 600 is open and the second end thereof is closed, the branch part 600 may reduce the vibration and noise by the refrigerant flowing in the enclosed space independently of the position and direction thereof.

However, the branch part 600 may protrude and extend from the compression part 300 or the muffler 500 in the direction of the rotation shaft 230. The reason for this is that when the branch part 600 protrudes and extends in other directions rather than along the rotation shaft 230, the shape of the case 100 may change. Further, when the branch part 600 protrudes and extends from the compression part 300 in a direction perpendicular to the rotation shaft 230, the branch part 600 may not be connected to the enclosed space formed by the compression part 300 and muffler 500 so that the efficiency of reducing the vibration and noise may be degraded.

Thus, the branch part 600 may protrude and extend from the compression part 300 or the muffler 500 in the direction of the rotation shaft 230 and expand the enclosed space formed by the compression part 300 and the muffler 500. The branch part 600 may include a muffler branch 610, a shaft support portion branch 617, and a fixed scroll branch 620 to be described later.

Hereinafter, a case in which the branch part 600 is formed in the muffler 500 according to one implementation of the present disclosure will be described with reference to FIGS. 3A and 3B.

Figure 3A:
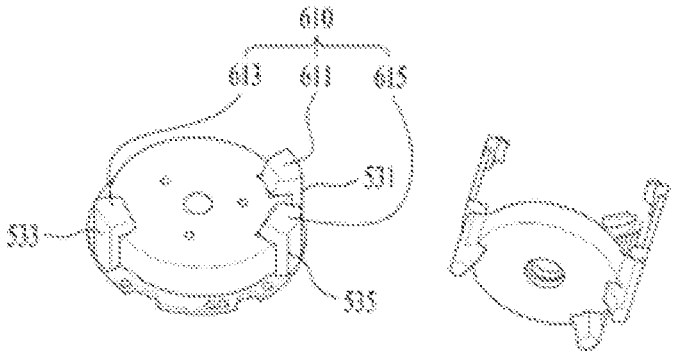
FIGS. 3A and 3B are views showing a muffler including a branch part installed in the lower scroll compressor according to one implementation of the present disclosure.

Referring to FIG. 3A, a muffler branch 610, which is formed in the muffler 500, may protrude and extend from the muffler 500 in a direction away from the compression part 300. Specifically, the muffler branch 610 may protrude and extend from one surface of the receiving body 510 facing the compression part 300 in the direction away from the compression part 300. The muffler branch 610 has a space therein, and the space may be connected to the collector part 530.

Thus, the muffler 500 may have not only a space in which the refrigerant flows but also a space for reducing the vibration and noise caused by the refrigerant.

To effectively reduce the vibration and noise caused by the refrigerant discharged from the muffler 500, the muffler branch 610 may be formed at a position corresponding to that of the collector part 530.

That is, a plurality of muffler branches 610 may be formed at positions respectively corresponding to those of the plurality of collectors 531, 533, and 535.

For example, the muffler branch 610 may include a first branch 611 that protrudes and extends from the first collector 531 in the direction away from the compression part 300, a second branch 613 that protrudes and extends from the second collector 533 in the direction away from the compression part 300, a third branch 615 that protrudes and extends from the third collector 535 in the direction away from the compression part 300.

When the plurality of muffler branches 610 are formed, the vibration and noise caused by the refrigerant discharged from the muffler 500 to the outlet 121 may be effectively reduced. In particular, when the refrigerant in the enclosed space flows into the guider 540 through the collector part 530, the flow path of the refrigerant is inevitably changed, and the change in the refrigerant flow path may cause the vibration and noise.

The plurality of muffler branches 611, 613, and 615 may effectively reduce the vibration and noise caused by the refrigerant flowing inside the plurality of collectors 531, 533, and 535 and the plurality of guiders 541, 543, and 545.

Depending on how long the branch part 600 protrudes and extends in the direction of the rotation shaft 230, the offset vibration frequency may change.

Figure 3B:
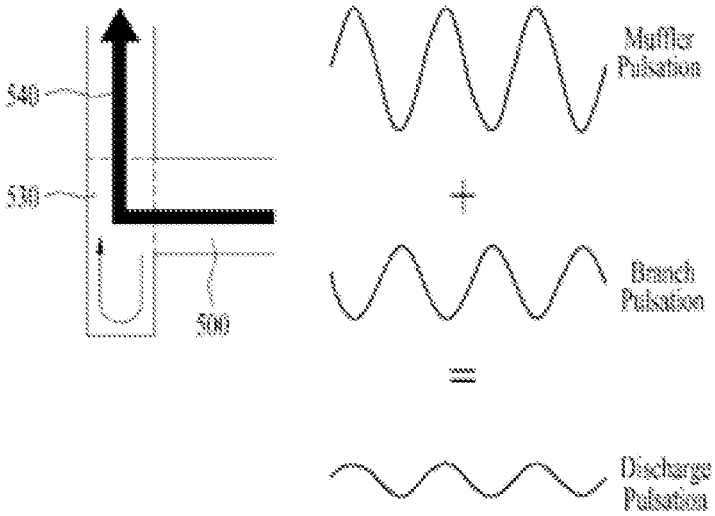

Referring to FIG. 3B, when the branch part 600 protrudes and extends in the direction of the rotation shaft 230 so that the branch part 600 has a predetermined length in the direction of the rotation shaft 230, the branch part 600 may have a resonance frequency. When the resonance frequency of the branch part 600 is a multiple (e.g., odd multiple) of a target frequency to be offset, the branch part 600 may generate a frequency with an opposite phase to the target frequency. Thus, the target frequency may be controlled by adjusting the extension of the branch part 600.

The vibration of the refrigerant discharged from the branch part 600 may be determined by adding the vibration of the refrigerant flowing inside the enclosed space formed by the muffler 500 and the compression part 300 and the vibration with an opposite phase to the vibration of the refrigerant, which is generated by the branch part 600. In this case, since the amplitude of the vibration of the refrigerant discharged from the branch part 600 is smaller than the amplitude of the vibration of the refrigerant flowing inside the enclosed space, the noise of the refrigerant may be reduced.

Hereinafter, the effects of the vibration reduction depending on the location of the branch part 600 will be described with reference to FIG. 4. FIG. 4 is a view showing that muffler branch 610 is formed in the muffler 500.

As described above, the first and second collectors 531 and 533 may be formed at the opposite positions, i.e., facing positions. The third collector 535 may be disposed between the first and second collectors 531 and 533, but the third collector 535 may be disposed closer to the second collector 533 than the first collector 531. In other words, the third collector 535 disposed along the circumference of the muffler 500 may be disposed farther away from the first collector 531 than the second collector 533.

The discharge hole 326 may discharge the refrigerant to the inside of muffler 500 at a location between a muffler shaft support portion 511, which is used to couple the rotation shaft 230 to the muffler 500, and the first collector 531

Thus, the distance between the discharge hole 326 and the first collector 531 may be shorter than the distance between the discharge hole 326 and the second collector 533. In addition, the distance between the discharge hole 326 and the first collector 531 may be shorter than the distance between the discharge hole 326 and the third collector 535.

In this case, a part of the refrigerant discharged from the discharge hole 326 may flow into the outlet 121 through the first collector 531, and the rest of the refrigerant discharged from the discharge hole 326 may flow into the outlet 121 through the second and third collectors 533 and 535.

In other words, the refrigerant discharged from the discharge hole 326 may be guided to the outlet 121 along a plurality of paths.

When the refrigerant flows along each of the plurality of paths, it may create vibration with different frequencies. Thus, each of the first, second, and third branches 611, 613, and 615 may have a different length.

The frequency of the vibration caused by the refrigerant guided to the outlet 121 through the first collector 531 may be offset by the first branch 611. Similarly, the frequency of the vibration caused by the refrigerant guided to the outlet 121 through the second collector 533 may be offset by the second branch 613, and the frequency of the vibration caused by the refrigerant guided to the outlet 121 through the third collector 535 may be offset by the third branch 615.

In other words, the frequency of the vibration caused by the refrigerant discharged from the discharge hole 326 may vary depending on the flow path of the refrigerant, and the frequency of the vibration generated when the flow direction of the refrigerant is changed in the collector part 530 may be offset by the collector part 530.

The refrigerant flowing along the plurality of multiple paths may generate vibration not only in the collector part 530 but also in the receiving body 510.

In particular, when the refrigerant discharged from the discharge hole 326 flows into the second or third collector 533 or 535, the amount of time for which the refrigerant flows inside the receiving body 510 may increase. That is, when the refrigerant discharged from the discharge hole 326 is guided to the outlet 121 through the second or third collector 533 or 535, the refrigerant may create more vibration in the receiving body 510 than when the refrigerant discharged from the discharge hole 326 is guided to the outlet 121 through the first collector 531.

As described above, when the branch part 600 is formed at the position corresponding to that of the collector part 530, it may be difficult to offset the frequency of the vibration caused when the refrigerant flows inside the receiving body 510. When the branch part 600 is formed at the position corresponding to that of the collector part 530, the branch part 600 may be suitable for offsetting the vibration generated when the flow direction of the refrigerant is changed in the collector part 530.

Accordingly, the compressor 10 may further include a shaft support portion branch 617 that protrudes and extends from a position not corresponding to that of the collector part 530 in the direction away from the compression part 300.

Hereinafter, the shaft support portion branch 617 will be described with reference to FIG. 5B.

The shaft support portion branch 617 may protrude and extend from a position between the muffler shaft support portion 511 and the collector part 530 in the direction away from the compression part 300.

That is, the shaft support portion branch 617 may protrude and extend from a position away from the collector part 530 toward the muffler shaft support portion 511 in the direction away from the compression part 300. The shaft support portion branch 617 may protrude and extend from one surface of the muffler 500 facing the compression part 300 in the direction away from the compression part 300. The shaft support portion branch 617 may have a space therein as in the first to third branches 611, 613, and 615, and the space may be connected to the enclosed space formed by the compression part 300 and the muffler 500.

The shaft support portion branch 617 may coexist with the first and third branches 611, 613, and 615. Thus, the shaft support portion branch 617 may be disposed in a direction away from the first branch 611 with respect to the muffler shaft support portion 511 and have no interference with the collector part 530.

The shaft support portion branch 617 may be disposed in a direction away from the second branch 613 with respect to the muffler shaft support portion 511 so that the shaft support portion branch 617 may be close to the first branch 611. However, it may be more preferable that the shaft support portion branch 617 is disposed in the direction away from the first branch 611 with respect to the muffler shaft support portion 511.

When the refrigerant discharged from the discharge hole 326 is guided to the outlet 121 through the first collector 531, the refrigerant may be in less contact with the receiving body 510. In other words, when the refrigerant discharged from the discharge hole 326 is guided to the outlet 121 through the third collector 535, the refrigerant may be in more contact with the receiving body 510 than when the refrigerant discharged from the discharge hole 326 is guided to the outlet 121 through the first collector 531.

Thus, to effectively offset the vibration generated when the refrigerant discharged from the discharge hole 326 flows inside the receiving body 510, the shaft support portion branch 617 may be disposed closer to the second or third collector 533 or 535 than the first collector 531.

In this case, the shaft support portion branch 617 may effectively offset the vibration generated when the refrigerant discharged from the discharge hole 326 flows into the second or third collector 533 or 535 due to contact with the receiving body 510

When the branch part 600 protrudes and extends from the muffler 500 in the direction away from the compression part 300, the axial length of the branch part 600 may be limited. For example, the muffler branch 610 that extends from one surface of the muffler 500 facing the compression part 300 in the direction away from the compression part 300 may be in contact with the oil stored in the case 100. In this case, the muffler branch 610 may be cooled down by the oil. Alternatively, the muffler branch 610 may not extend sufficiently in the direction away from the compression part 300 to avoid the contact with the oil.

Accordingly, the compressor 10 may further include a fixed scroll branch 620 formed on the fixed scroll 320.

Referring to FIG. 5A, the fixed scroll branch 620 may be recessed from the fixed scroll 320 in a direction away from the muffler 500. That is, the fixed scroll branch 620 may have a recessed space from the fixed scroll 320, and the space may be connected to the enclosed space formed by the compression part 300 and the muffler 500.

The fixed scroll 320 may include the bypass hole 327 connected to the guider 540 and configured to guide the refrigerant discharged from the muffler 500 to the outlet 121, which will be described later with reference to FIGS. 8A to 8C.

A plurality of bypass holes 327 may be formed in relation to a plurality of guiders 540. That is, the bypass hole 327 may include a first bypass hole 327*a* corresponding to the first guider 541, a second bypass hole 327*b* corresponding to the second guider 543, and a third bypass hole 327*c* (not shown in FIGS. 8A to 8C) corresponding to the third guider 545. The first and second bypass holes 327*a* and 327*b* may be formed at opposite positions, and the third bypass hole 327*c* may be disposed between the first and second bypass holes 327*a* and 327*b*.

When the first bypass hole 327*a* is disposed close to the discharge hole 326, the first bypass hole 327*a* may be located in a direction away from the fixed penetration hole 328 with respect to the discharge hole 326, and the second bypass hole 327*b* may be located in a direction away from the discharge hole 326 with respect to the fixed penetration hole 328.

The fixed scroll branch 620 may be disposed between the fixed penetration hole 328 and the bypass hole 327 to avoid interference with the bypass hole 327.

The fixed scroll branch 620 may be recessed from the fixed end plate 321 in the direction away from the muffler 500. The fixed scroll branch 620 may be recessed from a first surface of the fixed end plate 321 facing the muffler 500 toward a second surface of the fixed end plate 321 facing the orbiting scroll 330. However, the fixed scroll branch 620 may be spaced apart from the other surface.

When the fixed scroll branch 620 is excessively recessed from the first surface of the fixed end plate 321 so that the fixed scroll branch 620 is in contact with the second surface of the fixed end plate 321, the fixed scroll branch 620 may be in contact with the fixed wrap 323 that forms the compression chamber.

To form the fixed scroll branch 620, at least a part of the fixed side plate 322 may be recessed. That is, the fixed side plate 322 as well as the fixed end plate 321 may be recessed to form the fixed scroll branch 620. In this case, the fixed scroll branch 620 may be disposed close to the bypass hole 327 or the guider 540.

The fixed scroll branch 620 may be formed in a direction away from the discharge hole 326 with respect to the fixed penetration hole 328. The distance between the fixed penetration hole 328 and the discharge hole 326 may be smaller than the distance between the fixed scroll branch 620 and the fixed penetration hole 328. In summary, the fixed scroll branch 620 may be provided such that the fixed scroll branch 620 is disposed in the direction away from the discharge hole 326 with respect to the fixed penetration hole 328 and the distance between the fixed scroll branch 620 and the fixed penetration hole 328 is greater than the distance from the distance between the fixed penetration hole 328 and the discharge hole 326.

In this case, since the fixed scroll branch 620 is close to the bypass hole 327 or the guider 540, the fixed scroll branch 620 may effectively offset the vibration caused by the refrigerant flowing inside the guider 540 and the bypass hole 327. In addition, since the fixed scroll branch 620 prevents interference with the discharge hole 326, the reliability of the fixed end plate 321 may be improved.

As described above, the bypass hole 327 may be formed at the position corresponding to that of the guider 540. Considering that the guider 540 extends from the position corresponding to that of the collector part 530 in the direction of the rotation shaft 230 and the collector part 530 is disposed along the circumference of the muffler 500, the bypass hole 327 may be disposed along the circumference of the fixed scroll 320.

Thus, the distance between the fixed scroll branch 620 and the fixed penetration hole 328 may be smaller than the distance between the fixed penetration hole 328 and the bypass hole 327.

When the discharge hole 326 is closer to the first bypass hole 327*a* than the second bypass hole 327*b*, the fixed scroll branch 620 may be located between the second bypass hole 327*b* and the fixed penetration hole 328. When the refrigerant discharged from the discharge hole 326 flows into the first bypass hole 327*a*, the refrigerant may be in less contact with the receiving body 510. However, when the refrigerant discharged from the discharge hole 326 flows in the second bypass hole 327*b*, the refrigerant may cause the vibration due to contact with the receiving body 510.

The fixed scroll branch 620 may offset the vibration caused by the refrigerant flowing into the second bypass hole 327*b* due to the contact with the receiving body 510.

The fixed scroll branch 620 may be disposed close to the second bypass hole 327*b*. In other words, the distance between the fixed scroll branch 620 and the second bypass hole 327*b* may be smaller than the distance between the discharge hole 326 and the first bypass hole 327*a*.

In this case, the fixed scroll branch 620 may offset the vibration caused by the refrigerant discharged from the muffler 500.

To effectively reduce the vibration with various frequencies caused by the refrigerant flowing inside the muffler 500, the branch part 600 may be disposed at various positions.

As described above, the offset vibration frequency may be determined by the extension of the branch part 600 (the length in the direction of the rotation shaft 230). Thus, when the length of the branch part 600 in the direction of the rotation shaft 230 is changed and the shape of the branch part 600 is also changed, the branch part 600 may offset vibration with multiple frequencies.

Referring to FIGS. 6A to 6D, the branch part 600 may have various shapes. Hereinafter, the shape of the branch part 600 will be described with reference to FIGS. 6A to 6D.

Figure 6A:
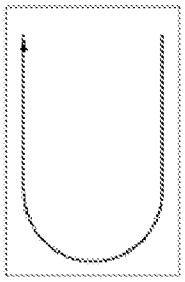
FIGS. 6A to 6D are views showing a plurality of branches according to one implementation of the present disclosure.

FIGS. 6A to 6D is a view showing the cross section of the branch part 600 in the direction of the rotation shaft 230. Referring to FIG. 6A, the branch part 600 may have a constant width along the extension direction. In this case, the branch part 600 may offset the vibration caused by the refrigerant by changing a single frequency phase.

Figure 6B:
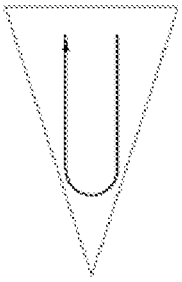
Figure 6C:
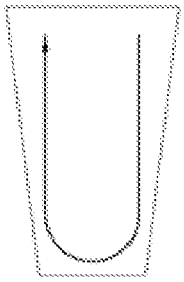
Figure 6D:
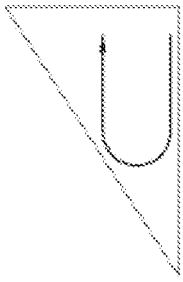

Referring to FIGS. 6B to 6D, the branch part 600 may be tapered along the extension direction. In this case, the branch part 600 may offset the vibration caused by the refrigerant by changing a plurality of frequency phases. The branch part 600 may generate frequencies with different phases from the frequency of the vibration caused by the refrigerant at different points in the shaft direction.

The cross section of the branch part 600 may be an isosceles triangle as shown in FIG. 6B, a trapezoid as shown in FIG. 6C, or a right triangle as shown in FIG. 6D.

Figure 7A:
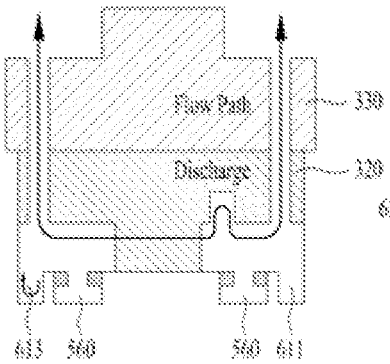
FIGS. 7A and 7B are views showing the compressor including the branch part and a resonator according to one implementation of the present disclosure.
Figure 7B:
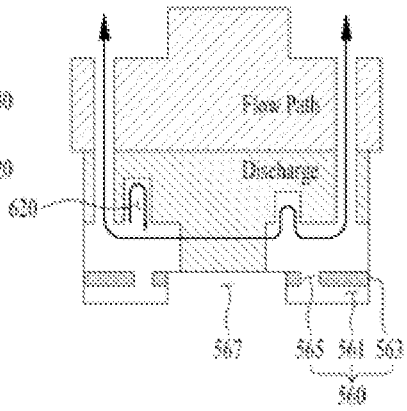

The branch part 600 may coexist with a resonator 560 having a predetermined space to reduce the vibration and noise caused by the refrigerant. Hereinafter, the branch part 600 coexisting with the resonator 560 will be described with reference to FIGS. 7A and 7B.

The resonator 560 may include a resonator cover 563 and a resonator hole 565. The resonator cover 563 is coupled to the inner circumferential surface of the muffler 500 and forms a cavity 561 by dividing the enclosed space formed by the compression part 300 and the muffler 500. The resonator hole 565 may penetrate the resonator cover 563 and connect the cavity 561 and the enclosed space.

In this case, the branch part 600 may be formed in the compression part 300 to avoid interference with the resonator 560, and more particularly, formed at the position corresponding to that of the collector part 530.

When the branch part 600 is formed at the position corresponding to that of the collector part 530, the resonator 560 may be disposed closer to the center of the muffler 500 than the collector part 530. In other words, the resonator 560 may be disposed toward the muffler shaft support portion 511 with respect to the collector part 530, thereby avoiding the inference with the branch part 600.

The principle how the resonator 560 offsets the vibration caused by the refrigerant may be related to the size of the cavity 561. Thus, the capability of the resonator 560 may be limited. The reason for this is that the cavity 561 of the resonator 560 is formed by dividing the enclosed space formed by the compression part 300 and the muffler 500. In this case, the resonator 560 may be suitable for offsetting low-frequency vibration, and the branch part 600 may be suitable for offsetting high-frequency vibration.

Accordingly, when the resonator 560 coexists with the branch part 600, both the low-frequency vibration and high-frequency vibration caused by the refrigerant may be offset. In other words, vibration with various frequencies may be offset.

When only the resonator 560 is installed in the compressor 10, the size of the muffler 500 in which the refrigerant flows may decrease. When the size of the muffler 500 in which the refrigerant flows decreases, the refrigerant in contact with the resonator cover 563 may cause vibration and noise. Thus, the volume of the cavity 561 may be limited. When the volume of the cavity 561 is limited, the capability of the resonator 560 may be limited.

When only the resonator 560 is installed in the compressor 10, it may be difficult to effectively offset the vibration caused by the refrigerant that change the flow direction in the muffler 500. As described above, the vibration caused by the refrigerant discharged from the muffler 500 may have a relatively high frequency, and the volume of a cavity formed in the muffler 500 may be limited.

Considering that it is difficult to form the resonator hole 565 close to the collector part 530, it may also be difficult for the resonator hole 565 to offset the vibration caused by the refrigerant discharged from the muffler 500. If the resonator hole 565 is formed close to the collector part 530, the resonator hole 565 may be connected to the collector part 530 so that the vibration caused by the refrigerant may not be offset by the cavity 561.

In summary, the branch part 600 may offset the vibration caused by the refrigerant flowing inside the muffler 500, and more particularly, effectively offset the vibration caused by the refrigerant discharged from the muffler 500.

Hereinafter, the operation of the lower scroll compressor 10 according to one implementation of the present disclosure will be described with reference to FIGS. 8A to 8C.

FIG. 8A shows the orbiting scroll 330, FIG. 8B shows the fixed scroll 320, and FIG. 8C shows a process in which the refrigerant is compressed by the orbiting scroll 330 and the fixed scroll 320.

The orbiting scroll 330 may include the orbiting wrap 333 on one surface of the orbiting end plate 331, and the fixed scroll 320 may include the fixed wrap 323 on one surface of the fixed end plate 321 facing the orbiting scroll 330.

The orbiting scroll 330 may include an enclosed rigid body to prevent the refrigerant from being discharged outside. The fixed scroll 320 may include the inflow hole 325, the discharge hole 326, and the bypass hole 327. The inflow hole 325 may be connected to a refrigerant supply pipe for the inflow of a low-temperature low-pressure refrigerant. The discharge hole 326 may be configured to discharge a high-temperature high-pressure refrigerant. The bypass hole 327 may be disposed on the outer circumferential surface of the fixed scroll 320 and configured to discharge the refrigerant discharged from the discharge hole 326.

The fixed wrap 323 and the orbiting wrap 333 may spirally extend from the outside of the fixed shaft support portion 3281. Thus, the radiuses of the fixed wrap 323 and the orbiting wrap 333 may be greater than those of the conventional scroll compressor. If the fixed wrap 323 and the orbiting wrap 333 are formed in an involute or logarithmic spiral shape as in the prior art, the curvature thereof decreases so that the compression ratio also decreases. Further, the strength of the fixed wrap 323 and the orbiting wrap 333 may decrease, and as a result, the fixed wrap 323 and the orbiting wrap 333 may be deformed.

Therefore, the fixed wrap 323 and the orbiting wrap 333 of the compressor 10 may be formed to have a plurality of circular arcs where the curvature continuously changes. For example, the fixed wrap 323 and the orbiting wrap 333 may be implemented as a hybrid wrap having 20 or more circular arcs combined therein The lower scroll compressor 10 is implemented such that the rotation shaft 230 penetrates the fixed scroll 320 and the orbiting scroll 330, and thus the radius of the curvature and compression space of the fixed wrap 323 and the orbiting wrap 333 are reduced.

To compensate for such a disadvantage, the radius of the curvature of the fixed wrap 323 and the orbiting wrap 333 of the compressor 10 immediately before the discharge may be smaller than that of the penetrated shaft support portion of the rotation shaft 230 so that the space to which the refrigerant is discharged may be reduced and the compression ratio may be improved. In other words, the fixed wrap 323 and the orbiting wrap 333 may be further bent in the vicinity of the discharge hole 326. The fixed wrap 323 and the orbiting wrap 333 may be more bent toward the inflow hole 325 so that the radius of the curvature of the fixed wrap 323 and the orbiting wrap 333 may vary point to point in response to the bending.

Referring to FIG. 8C, refrigerant I flows into the inflow hole 325 of the fixed scroll 320, and refrigerant II, which flowed thereinto before the refrigerant I, is located in the vicinity of the discharge hole 326 of the fixed scroll 320.

In this case, refrigerant I is present in an area on the outer circumferential surfaces of the fixed wrap 323 and the orbiting wrap 333 where the fixed wrap 323 and the orbiting wrap 333 are engaged, and refrigerant II is present and enclosed in an area where the fixed wrap 323 and the orbiting wrap 333 are engaged at two points.

When the orbiting scroll 330 starts to orbit, the area where the fixed wrap 323 and the orbiting wrap 333 are engaged at two points moves according to a change in the position of the orbiting warps 333 along the extension direction of the orbiting wrap 333 so that the volume thereof starts to decrease. Thereafter, refrigerant I moves and starts to be compressed. Refrigerant II is further reduced in volume and compressed, and then guided to the discharge hole 326.

Refrigerant II is discharged from the discharge hole 326. As the area where the fixed wrap 323 and the orbiting wrap 333 are engaged at two points moves, refrigerant I moves and starts to be reduced in volume and compressed.

As the area where the fixed wrap 323 and the orbiting wrap 333 are engaged at two points moves again in the clockwise direction to be closer to the interior of the fixed scroll 320, the volume of refrigerant I further decreases and refrigerant II is almost discharged.

As described above, as the orbiting scroll 330 orbits, the refrigerant may be compressed linearly or continuously while flowing into the fixed scroll 320.

Although the drawing shows that the refrigerant flows into the inflow hole 325 discontinuously, this is for illustrative purposes only. That is, the refrigerant may be supplied continuously. Further, the refrigerant may be accommodated and compressed in each area where the fixed wrap 323 and the orbiting wrap 333 are engaged at two points As is apparent from the above description, the present disclosure has effects as follows.

According to the present disclosure, the compressor may mitigate the vibration and noise caused by the refrigerant flowing inside the muffler without additional components.

The compressor may offset vibration with various frequencies generated in the muffler.

The compressor may offset vibration with a specific frequency generated in the muffler.

The compressor may effectively mitigate the vibration and noise that depend on the flow path of the refrigerant flowing inside the muffler.

The compressor may reduce the flow loss of the refrigerant flowing inside the muffler.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

What is claimed is:

1. A compressor comprising:

a case that includes an outlet configured to discharge refrigerant;

a rotation shaft;

a driver that is coupled to the case and configured to rotate the rotation shaft;

a compression part that is coupled to the rotation shaft and compresses the refrigerant in a compression chamber, the compression part including a fixed scroll and an orbiting scroll, the orbiting scroll being coupled to the rotation shaft, wherein the fixed scroll and the orbiting scroll define the compression chamber;

a muffler that is coupled to the compression part, wherein the muffler and the compression part define an enclosed space configured to guide the refrigerant to the outlet of the case;

a branch part that extends from at least one of the compression part or the muffler in a longitudinal direction of the rotation shaft and that defines an additional space to the enclosed space, wherein the additional space is configured to reduce vibration or noise caused by movement of the refrigerant; and a resonator that is disposed at the muffler and that defines a cavity by dividing the enclosed space such that the vibration or noise caused by movement of the refrigerant is reduced, wherein the branch part extends from the muffler in a first direction away from the compression part, and wherein the muffler comprises:

a muffler shaft support portion that is coupled to the rotation shaft, and a collector part that extends from the muffler in a radial direction of the rotation shaft away from the rotation shaft and that is configured to guide the refrigerant to the outlet of the case, wherein the branch part extends from the collector part in the first direction away from the compression part.

2. The compressor of claim 1, wherein the collector part comprises:

a first collector that extends from a first side of the muffler in the radial direction of the rotation shaft away from the enclosed space; and a second collector that extends from a second side of the muffler in the radial direction of the rotation shaft away from the enclosed space, and wherein the branch part comprises:

a first branch that extends from the first collector in the first direction away from the compression part; and a second branch that extends from the second collector in the first direction away from the compression part.

3. The compressor of claim 2, wherein a length of extension of the first branch from the first collector in the first direction away from the compression part is different from a length of extension of the second branch from the second collector in the first direction away from the compression part.

4. The compressor of claim 2, wherein the first and second branches extend from opposite positions with respect to the first direction away from the compression part.

5. The compressor of claim 1, wherein the branch part is tapered in the first direction away from the compression part.

6. The compressor of claim 2, wherein the branch part further comprises a shaft support portion branch that extends between the collector part and the muffler shaft support portion in the first direction away from the compression part.

7. The compressor of claim 1, wherein the fixed scroll is coupled to the muffler; and wherein the orbiting scroll is disposed relative to the fixed scroll in a second direction away from the muffler, and wherein the branch part is recessed from the fixed scroll in the second direction away from the muffler.

8. The compressor of claim 7, wherein the fixed scroll comprises:

a fixed penetration hole that receives the rotation shaft; and a discharge hole that is defined at a location away from the fixed penetration hole and that is configured to discharge, to the muffler, the refrigerant compressed in the compression chamber, wherein a distance between the branch part and the fixed penetration hole is greater than a distance between the discharge hole and the fixed penetration hole.

9. The compressor of claim 8, wherein the fixed scroll comprises a bypass hole that is configured to guide the refrigerant discharged from the discharge hole to the outlet of the case, and wherein a distance between the bypass hole and the fixed penetration hole is greater than a distance between the branch part and the fixed penetration hole.

10. The compressor of claim 9, wherein the bypass hole comprises:

a first bypass hole that is configured to guide, to the outlet of the case, the refrigerant discharged from the discharge hole based on the first bypass hole being located opposite to the fixed penetration hole with respect to the discharge hole; and a second bypass hole that is configured to guide, to the outlet of the case, the refrigerant discharged from the discharge hole based on the second bypass hole being located opposite to the discharge hole with respect to the fixed penetration hole, wherein the branch part is located between the second bypass hole and the fixed penetration hole.

11. The compressor of claim 10, wherein a distance between the branch part and the second bypass hole is smaller than a distance between the discharge hole and the first bypass hole.

12. The compressor of claim 1, wherein the driver comprises:

a stator that is configured to generate a magnetic field; and a rotor that is coupled to the rotation shaft and configured to rotate based on the magnetic field.

13. The compressor of claim 7, wherein the muffler comprises:

a coupling body that is coupled to the fixed scroll; and a receiving body that extends from the coupling body and defines a sealed space.

14. The compressor of claim 1, wherein the muffler comprises:

a first collector that extends in a radial direction of the rotation shaft away from the enclosed space;

a second collector that extends in the radial direction of the rotation shaft away from the enclosed space; and a third collector that is disposed between the first and second collector.

15. The compressor of claim 14, wherein the third collector is disposed closer to the second collector than the first collector.

16. The compressor of claim 14, wherein the first collector extends in an opposite direction to the second collector.

* * * * *